US007704089B2

(12) United States Patent
Tseng

(10) Patent No.: US 7,704,089 B2
(45) Date of Patent: Apr. 27, 2010

(54) MODULAR SLIM CONNECTOR

(75) Inventor: Ting-Chang Tseng, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/338,553

(22) Filed: Dec. 18, 2008

(65) Prior Publication Data

US 2009/0215295 A1 Aug. 27, 2009

(51) Int. Cl.
*H01R 13/74* (2006.01)

(52) U.S. Cl. ..... 439/248; 439/247

(58) Field of Classification Search ..... 439/247, 439/248, 246
See application file for complete search history.

(56) References Cited

U.S. PATENT DOCUMENTS 4,647,130 A * 3/1987 Blair et al. ..... 439/248
5,514,000 A * 5/1996 Krause et al. ..... 439/248
5,575,673 A * 11/1996 Dahlem et al. ..... 439/248
6,196,856 B1 * 3/2001 De Villeroche ..... 439/248
6,307,753 B1 * 10/2001 Baginy et al. ..... 361/796
7,311,525 B2 * 12/2007 Koiwaya et al. ..... 439/31
2008/0287005 A1 * 11/2008 Kameda ..... 439/498

* cited by examiner

*Primary Examiner*—Michael C Zarroli
(74) *Attorney, Agent, or Firm*—Stephen L. Sheldon

(57) ABSTRACT

A floating type electrical connecting device, comprises: first and second electrical connectors. The first electrical connector includes a first insulating housing, and a plurality of first conductive terminals. The first insulating housing has a first mating surface, a plugging surface located on an opposite side of the first mating surface, two side surfaces respectively connected at opposite left and right sides of the first mating surface and the plugging surface, and a plurality of first terminal grooves extending from the mating surface to the plugging surface through the first insulating housing. In addition, a vertical lateral protruding edge is formed at each side surface adjacent to the first mating surface, and protruding from the side surface. The second electrical connector includes a second insulating housing, and a plurality of second conductive terminals. The second insulating housing has two sliding grooves respectively for receiving the two lateral protruding edges.

20 Claims, 16 Drawing Sheets

MODULAR SLIM CONNECTOR

RELATED CASES

This application claims priority to Taiwan Application 96221517, filed Dec. 18, 2007, which is incorporated herein by reference in its entirety.

FIELD OF THE INVENTION

The present utility model relates to an electrical connector, more particularly to a floating type electrical connector that permits easy mold making, that is convenient to manufacture, and that has better strength.

BACKGROUND OF THE INVENTION

With reference to FIG. 1, FIG. 2 and FIG. 3, R.O.C. Utility Model Patent No. 306729 owned by the applicant discloses a floating type electrical connector assembly 90, which comprises a first electrical connector 91 for assembly and electrical connection to an electronic device 901, and a second electrical connector 92 for mounting on an electrical circuit board 902.

Each conductive terminal 93 of the first electrical connector 91 is formed with a flat plate-shaped adapting segment 931, and the adapting segments 931 can be supported by a first insulating housing 94. A vertical guide rail 941 is provided downwardly of each of two sides of the first insulating housing 94. A second insulating housing 95 of the second electrical connector 92 has two sides respectively provided with vertical sliding grooves 951 that cooperate with the two guide rails 941. Thus, the first electrical connector 91 can be coupled to the second electrical connector 92 in a top-down direction, and can be plugged and unplugged multiple times without resulting in bending and damage to the adapting segments 931 of the conductive terminals 93. Enabling horizontal plugging connection or vertical plugging connection of the first electrical connector 91 to the second electrical connector 92 multiple times is to overcome the drawback of prior floating type electrical connector assemblies, such as that disclosed in R.O.C. Utility Model Patent No. 265798, which are not suitable for multiple plugging connections because the adapting segments of the conductive terminals of the electrical connectors therein are suspended and easily damaged if subjected to multiple plugging connections.

However, the design of the shapes of the two vertical guide rails 941 of the first insulating housing 94 and the structure of the sliding grooves 952 that are formed in the second insulating housing 95 to cooperate with and to receive the two vertical guide rails 941 result in that the first insulating housing 94 and the second insulating housing 95 have irregular shapes with more jaggedness and twists.

Since current methods for manufacturing insulating housings mainly involve use of injection molding processes for relative ease and convenience, if the shapes of the insulating housings are more irregular, the difficulty in preparing the molds is greater, and it is relatively not easy to prepare the formed bodies. Therefore, there is still room for improvement as to how to simplify the shapes of the insulating housings.

SUMMARY OF THE INVENTION

Therefore, the floating type electrical connecting device of the present utility model comprises: a first electrical connector and a second electrical connector.

The first electrical connector includes a first insulating housing and a plurality of electrically conductive first terminals. The first insulating housing has a first mating surface, a plugging surface located on an opposite side of the first mating surface, two side surfaces respectively connected to opposite left and right sides of the first mating surface and the plugging surface, and a plurality of first terminal grooves extending from the mating surface to the plugging surface through the first insulating housing for receiving the first conductive terminals. Each side surface is formed with a vertical lateral protruding edge at a location proximate to the first mating surface and extending from the respective side surface.

The second electrical connector includes a second insulating housing, and a plurality of second conductive terminals. The second insulating housing has a top surface, a bottom surface, a second mating surface, and a plurality of second terminal grooves disposed along a direction from the top surface to the bottom surface for receiving the second conductive terminals. The second mating surface is formed with a plurality of front openings that are respectively communicated with the second terminal grooves. Two sliding grooves are formed respectively in two sides of the second insulating housing adjacent to the second mating surface. The two sliding grooves are respectively for receiving the two lateral protruding edges of the first insulating housing.

Preferably, a side of each of the lateral protruding edges which is adjoined to the second mating surface form a continuous flat surface with the first mating surface.

Further, the first insulating housing further has an upper side surface and a lower side surface which are respectively connected to opposite upper and lower sides of the first mating surface and the plugging surface. The first insulating housing is further formed with a lower protruding edge protruding from the lower side surface and connected to the two lateral protruding edges.

Furthermore, the first insulating housing is further formed with an upper protruding edge protruding from the upper side surface and connected to the two lateral protruding edges.

With the design of the two lateral protruding edges which protrude from the side surfaces at locations adjacent to the first mating surface, and preferably by having one side of each of the lateral protruding edges forms a continuous flat surface with the first mating surface, the shapes of the first insulating housing and the matching second insulating housing are neat, rendering mold making easier, and also facilitating production. Further, the first insulating housing can be formed with a lower protruding edge and an upper protruding edge connected to the two lateral protruding edges to increase the area for application of force to grip the first electrical connector, so as to facilitate assembly of the first electrical connector with an electronic device.

Therefore, an object of the present utility model is to provide a floating type electrical connecting device whose insulating housing structure is more convenient to manufacture.

Another object of the present utility model is to provide a floating type electrical connecting device with better strength.

BRIEF DESCRIPTION OF THE DRAWINGS

The aforesaid and other technical contents, features and advantages of the present utility model will be clearly presented in the following detailed description of three preferred embodiments with reference to the drawings.

DETAILED DESCRIPTION

Figure 1:
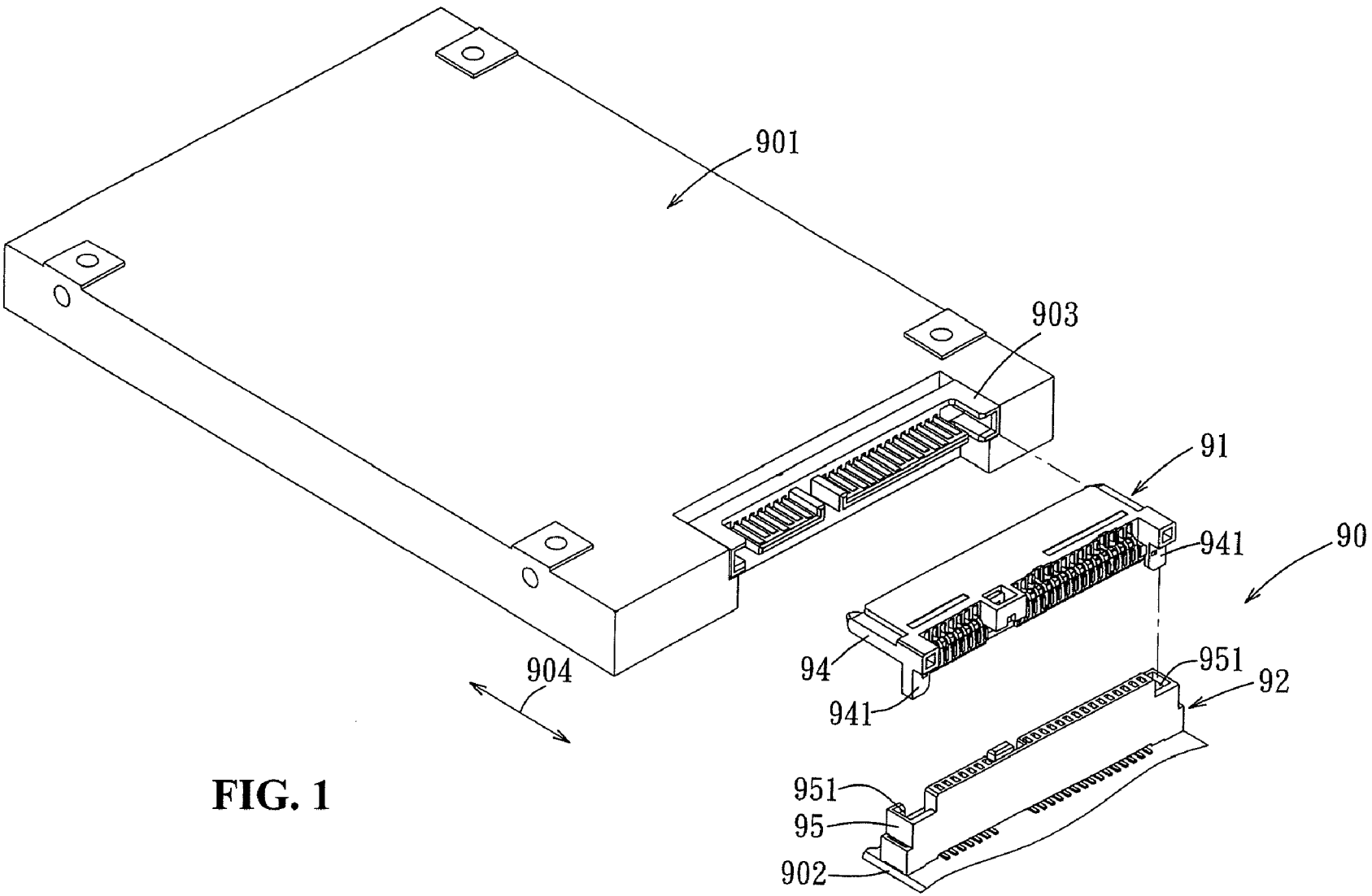
FIG. 1 is a perspective view, illustrating a conventional floating type electrical connector assembly, and an electronic device and a circuit board.
Figure 2:
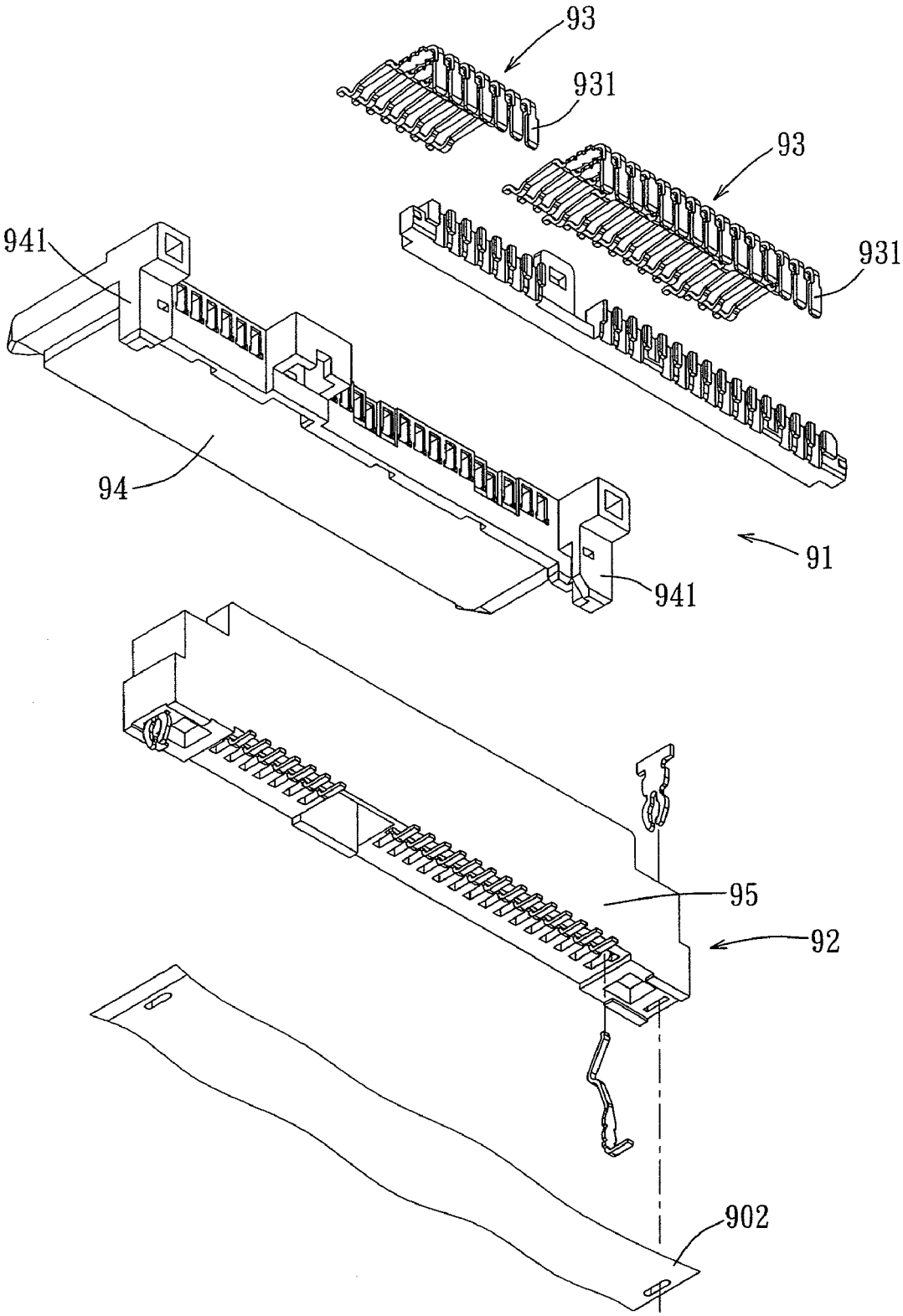
FIG. 2 is an exploded perspective view, illustrating components of the conventional floating type electrical connector assembly.
Figure 3:
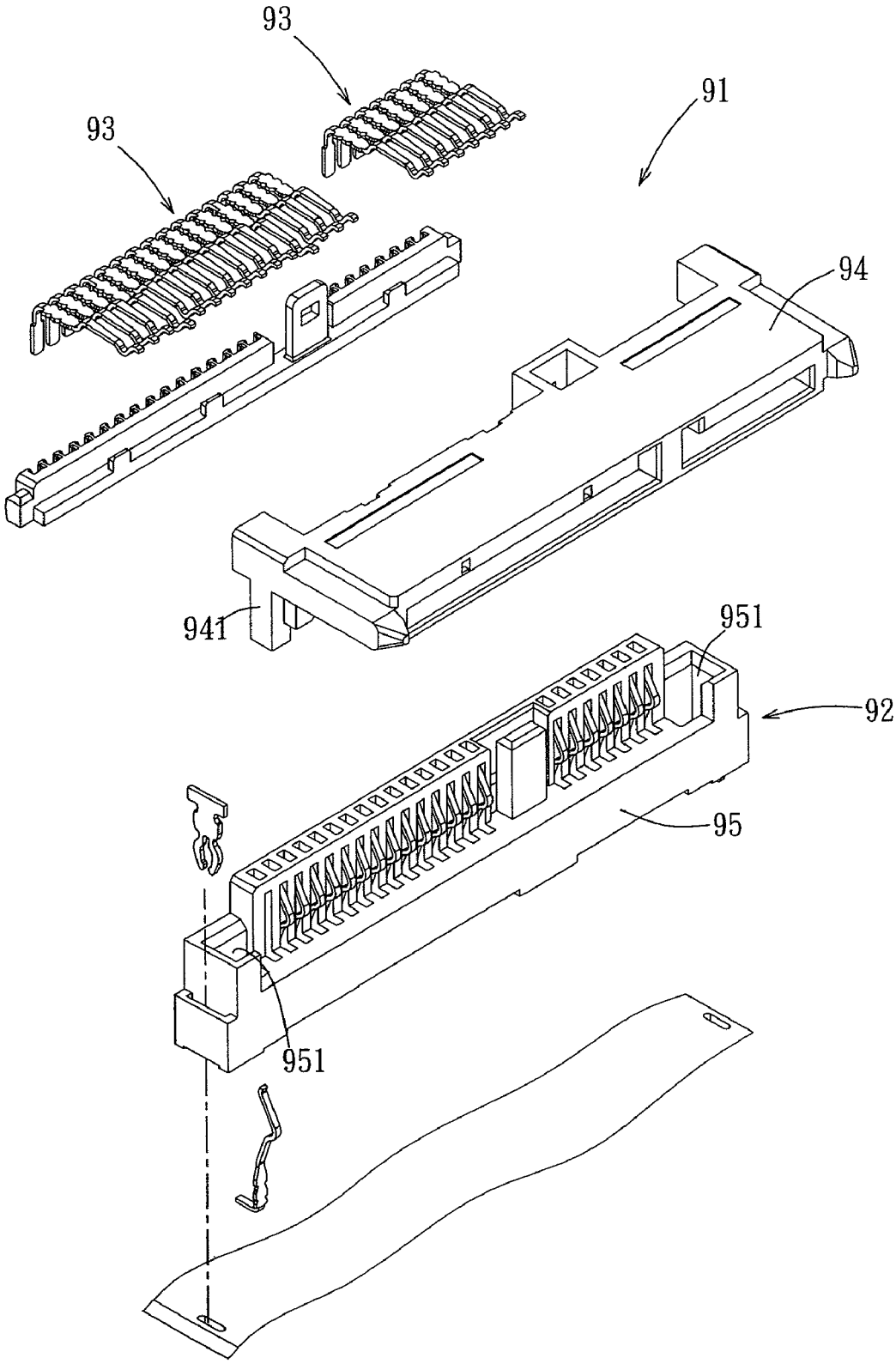
FIG. 3 is an elevational view of FIG. 2 viewed from another angle, illustrating the components of the conventional floating type electrical connector assembly.

Before the present utility model is described in detail, it should be noted that in the following description content, similar components are represented by identical numerals.

In order to make the insulating housings easier to manufacture, the inventor of the present application continued with the concept of the prior art that the first electrical connector and the second electrical connector can be plugged and unplugged multiple times, and further modified the shapes of the insulating housing of the first electrical connector and the insulating housing of the second electrical connector.

The insulating housing of the first electrical connector is formed with a vertical lateral protruding edge at each of left and right sides of a mating surface thereof, such that the vertical lateral protruding edges on the two sides serve as guiding rails, and can be engaged slidingly with matching sliding grooves in two sides of the insulating housing of the second electrical connector. As compared to the two downwardly extending guiding rails 941 of the first electrical connector 91 in the prior art, the two lateral protruding edges can form a continuous flat surface with the mating surface, such that the shape is neater and manufacture is easier. In addition, the two lateral protruding edges are connected to a side surface of the first insulating housing in a lengthwise direction thereof. As compared to the guiding rails 941 which have shorter side thereof connected to a main body of the first insulating housing 94, the stress borne by the two lateral protruding edges is more distributed, so that breaking is less easy. Further, the sliding grooves in the second insulating housing of the present utility model are respectively defined cooperatively by two L-shaped side walls that are connected to two sides of the second mating surface in the lengthwise direction thereof and that are opposite to each other, and the mating surface, such that the shape of the second insulating housing can be more easily manufactured as compared to the second insulating housing of the aforementioned prior art.

Furthermore, the first insulating housing can be further formed with an upper protruding edge and a lower protruding edge that are connected to the two lateral protruding edges. This not only enhances the strength of the two lateral protruding edges, but also increases the area for application of force by a user gripping the first electrical connector, thereby facilitating assembly of the first electrical connector to an electronic device or removal thereof from the electronic device.

Moreover, the present utility model further provides concrete embodiments where the second electrical connector can be mounted to the circuit board in three different arrangements, namely, above, below, or sinkingly in the board. The aforesaid Patent No. M306729 is incorporated into the present application by reference.

In the embodiment presented below, the floating type electrical connecting device of the present utility model and a mating electrical connector of a matching electronic device both conform to the Serial Advanced Technology Attachment (SATA) standard.

Figure 4:
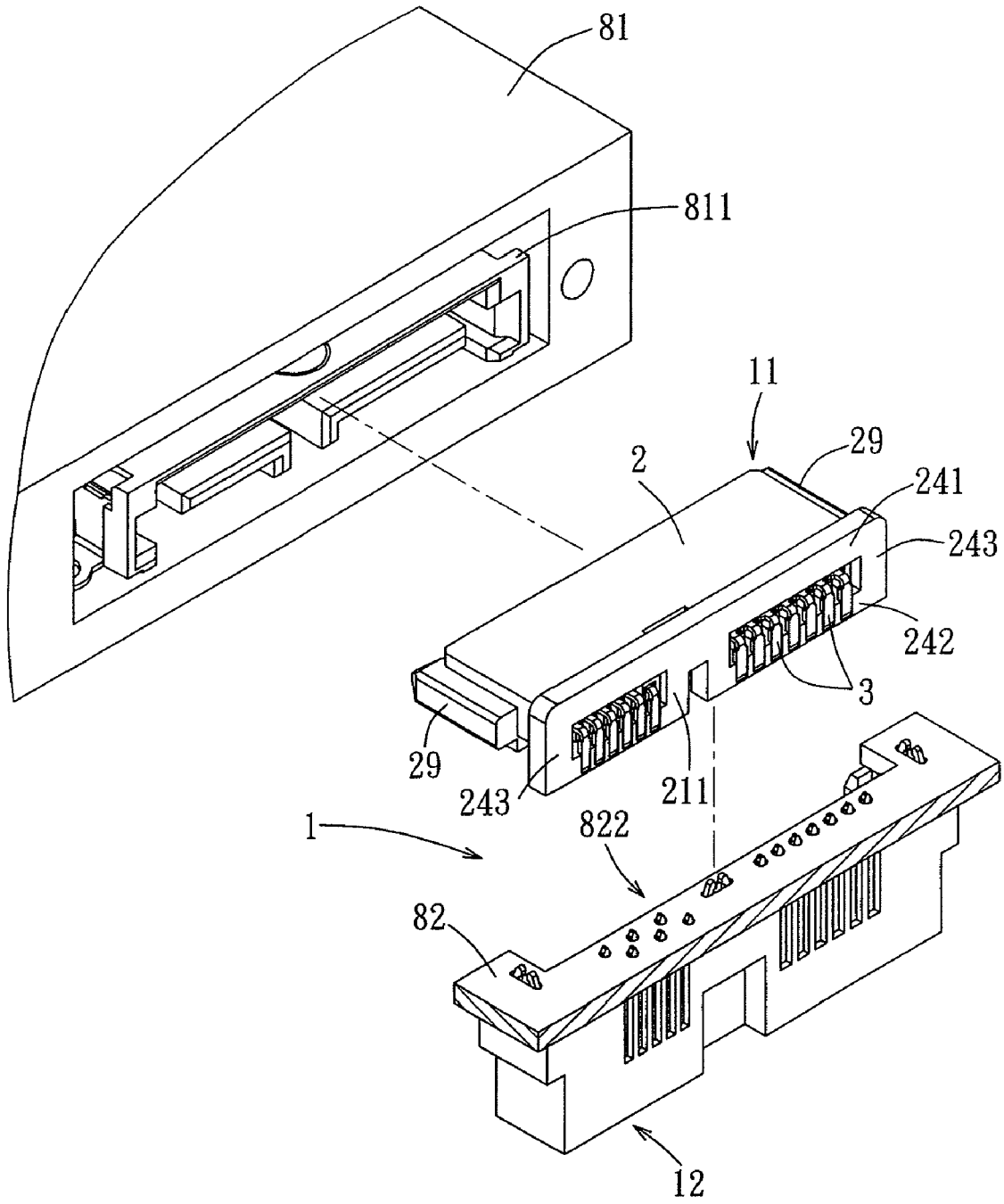
FIG. 4 is a perspective view, illustrating a first preferred embodiment of the floating type electrical connecting device of the present utility model, and an electronic device and a circuit board.
Figure 5:
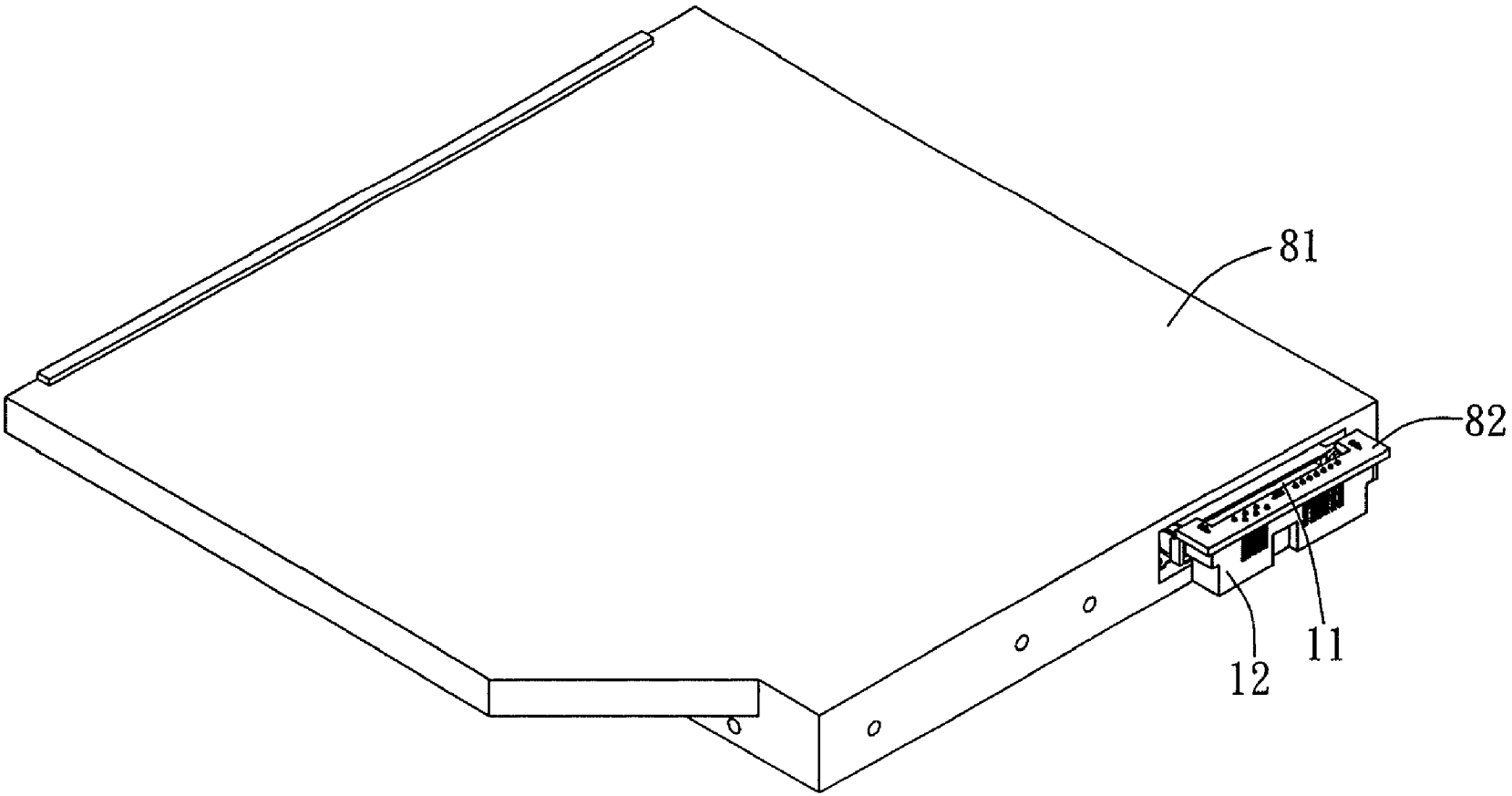
FIG. 5 is an assembled view of FIG. 4, illustrating assembly of the first preferred embodiment to the electronic device and the circuit board.
Figure 6:
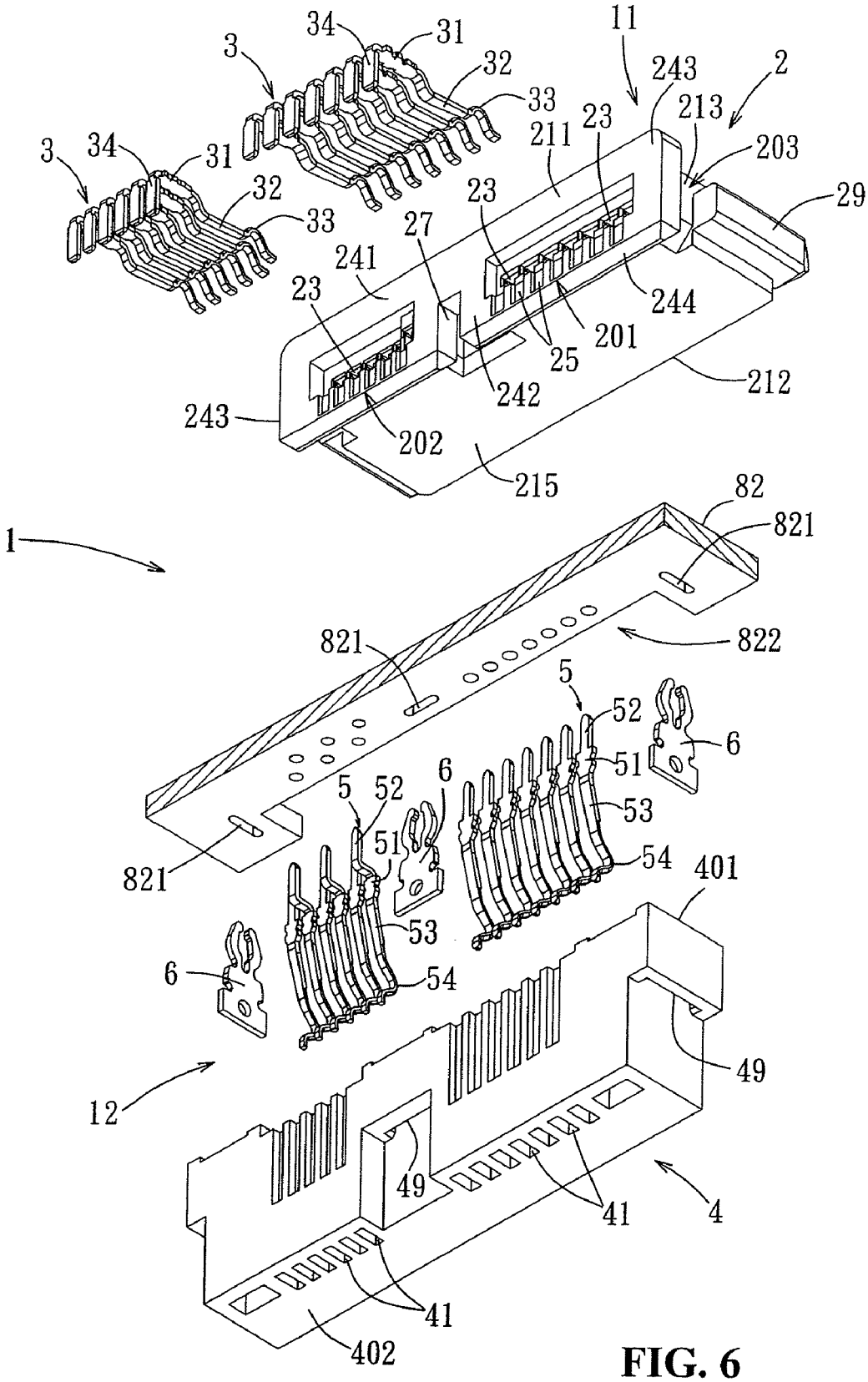
FIG. 6 is an exploded perspective view, illustrating components of the first preferred embodiment.
Figure 7:
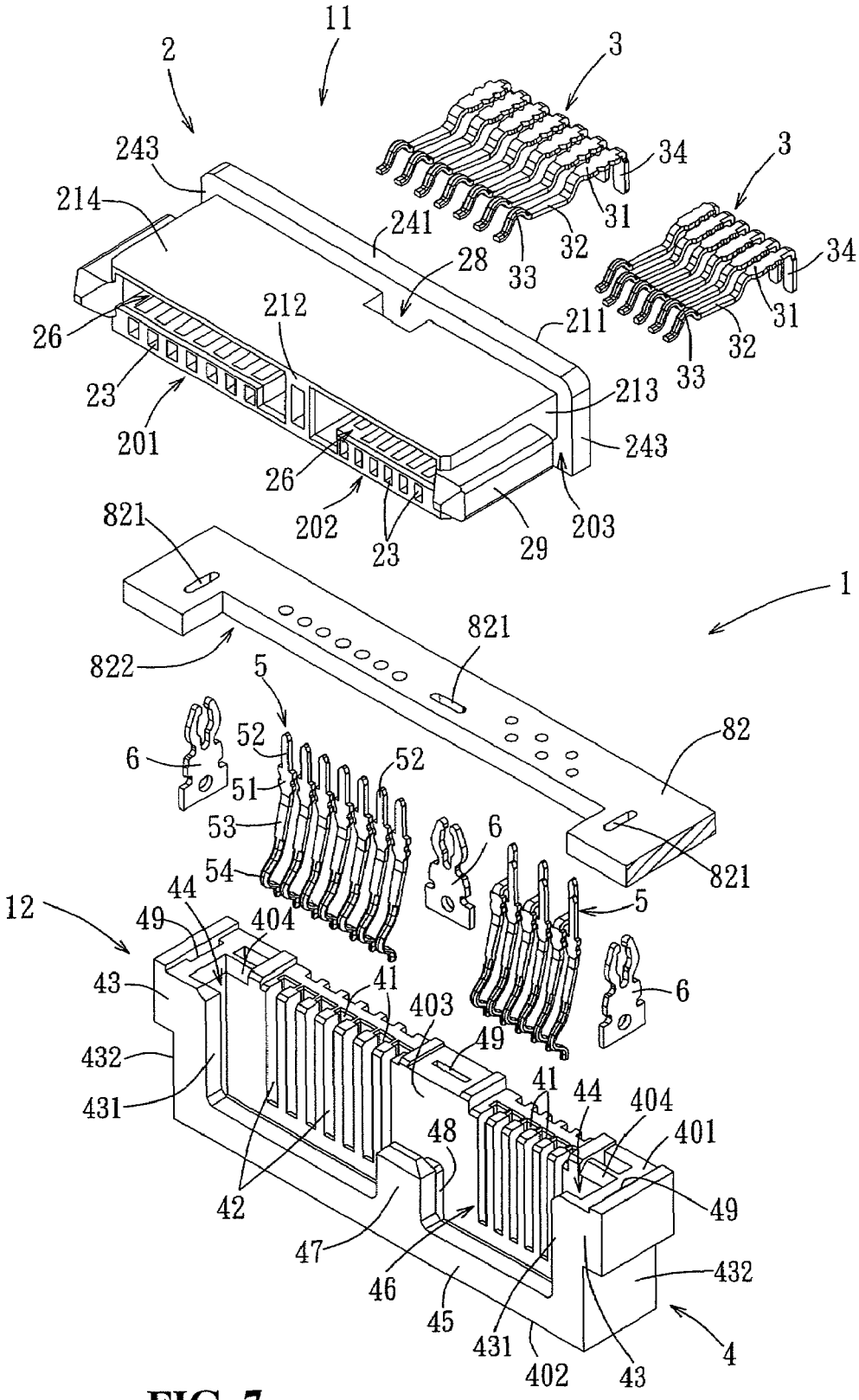
FIG. 7 is an elevational view of FIG. 6 viewed from another angle, illustrating the components of the first preferred embodiment.

With reference to FIG. 4 and FIG. 5, a first preferred embodiment of the floating type electrical connecting device of the present utility model discloses a floating type electrical connecting device 1 that comprises a first electrical connector 11, a second electrical connector 12, and a circuit board 82 that is formed with an indentation 822, wherein the first electrical connector 11 can be connected electrically to a mating electrical connector 811 of an electronic device 81 (e.g., an optical disc drive or a hard disk), and the second electrical connector 12 can be mounted beneath the circuit board 82. The indentation 822 can permit passing of the first electrical connector 11 therethrough, such that the first electrical connector 11 can pass through the indentation 822 to be mated with the second electrical connector 12 in a top-down direction, thereby electrically connecting the electronic device 81 to the circuit board 82.

With reference to FIG. 4, FIG. 6, FIG. 7, and FIG. 8, the first electrical connector 11 includes a first insulating housing 2 that is made from an insulating material, and a plurality of first conductive terminals 3.

The first insulating housing 2 is of an elongated shape, has a first mating surface 211, a plugging surface 212 located at an opposite side of the first mating surface 211, two side surfaces 213 respectively connected at opposite left and right sides of the first mating surface 211 and the plugging surface 212, an upper side surface 214 and a lower side surface 215 respectively connected to opposite upper and lower sides of the first mating surface 211 and the plugging surface 212, and a plurality of first terminal grooves 23 that extend through the first insulating housing 2 from the first mating surface 211 to the plugging surface 212. In addition, at four peripheral sides immediately adjacent to the first mating surface 211, there are respectively formed two vertical lateral protruding edges 243 protruding respectively from the side surfaces 213, a lower protruding edge 242 protruding from the lower side surface 215 and connected to the two lateral protruding edges 243, and an upper protruding edge 241 protruding from the upper side surface 214 and connected to the two lateral protruding edges 243. Since the two lateral protruding edges 243 are connected to the side surfaces 213 in a lengthwise direction thereof, stress can be better distributed so that breaking and cracking would be less easy, and there can be better strength. With the connection to the upper and lower protruding edges 241, 242, the connecting strength between the two lateral protruding edges 243 and the side surfaces 213 can be further enhanced.

In this embodiment, sides of the two lateral protruding edges 243, the lower protruding edge 242, and the upper protruding edge 241 which are adjoined to the second electrical connector 12 form a continuous flat surface with the first mating surface 211, i.e., one side of each of the two lateral protruding edges 243, the lower protruding edge 242 and upper protruding edge 241 are coplanar with the first mating surface 211, such that the side of the first insulating housing 2 mating with the second electrical connector 12 is generally of a plate shape. Moreover, the lower protruding edge 242 is recessed and is provided with a plurality of positioning grooves 25 corresponding to the first terminal grooves 23, and a bottom side of the lower protruding edge 242 is substantially conical and forms a first guiding surface 244.

The first conductive terminals 3 comprise power source terminals and signal terminals. In this example, a plurality of the power terminals are concentrated in one area. For the sake of illustration, the location of the plurality of the first terminal grooves 23 for receiving the power terminals are referred to as a power source area 201. Similarly, a plurality of the signal terminals are concentrated in another area, and the locations of the plurality of the first terminal grooves 23 for receiving these signal terminals are referred to as a signal area 22. The power source area 201 and the signal area 202 are left-right arranged, and are respectively recessed in the plugging surface 22 to form plugging openings 26 that are in spatial communication with the first terminal grooves 23 and that permit plugging of the mating electrical connector 811. There is further formed, in the first mating surface 21 between the power source area 201 and the signal area 202, a notch 27 that extends from the lower protruding edge 242 toward the upper protruding edge 241, and, adjacent to the notch, there is further formed a vertical shaft 28 that is proximate to the first mating surface 21 and that is in spatial communication with the notch 27.

The first insulating housing 2 further has two horizontal positioning posts 29 respectively disposed at the side surfaces 213 to serve as horizontal guide rails when the first electrical connector 11 is plugged into the mating electrical connector 811. Each of the positioning posts 29 forms a gap 203 with the corresponding lateral protruding edge 243.

Each of the first conductive terminals 3 is plugged into the corresponding first terminal groove 23 from the first mating surface 211 of the first insulating housing 2, has a fixing segment 31 fixed on a groove wall forming the respective first terminal groove 23, a resilient segment 32 bending and extending from one end of the fixing segment 31 toward the plugging surface 212, a contacting segment 33 bending and extending from a front end of the resilient segment 32 toward the plugging surface 212, and protruding in a respective plugging opening 26, and a flat plate-shaped adapting segment 34 protruding outwardly of the respective first terminal groove 23 from the other end of the fixing segment 31 and extending perpendicularly downward so as to be received in the corresponding positioning groove 25. The adapting segments 34 abut against the first insulating housing 2, and can be supported by the first insulating housing 2. In this embodiment, the first insulating housing 2 is formed with the lower protruding edge 242 such that the positioning grooves 25 can extend downwardly from the first mating surface 211 to the lower protruding edge 242, and the adapting segments 34 of the first conductive terminals 3 can be lengthened so as to increase a range of floating between the first electrical connector 11 and the second electrical connector 12 in the mating direction. However, if the first insulating housing 2 is not provided with the lower protruding edge 242, the positioning grooves 25 can be formed only in the first mating surface 211 for receiving the adapting segments 34. Certainly, the adapting segments 34 can be shorter.

The second electrical connector 12 includes a second insulating housing 4 made from an insulating material, and a plurality of second conductive terminals 5.

The second insulating housing 4 is of an elongated shape and is vertical, has a top surface 401, a bottom surface 402, a second mating surface 403, and a plurality of second terminal grooves 41 disposed along a direction from the top surface 401 to the bottom surface 402 and extending through the top surface 401. Moreover, there is formed in the second mating surface 403 a plurality of front openings 42 that correspond respectively to the second terminal grooves 41 and that are communicated therewith, and two L-shape side walls 43 that are connected to two sides of the second mating surface 403 along a lengthwise direction thereof and that are opposite to each other. The two side walls 43 and the second mating surface 403 cooperatively define two sliding grooves 44. An entrance of each of the sliding grooves 44 is located at the top surface 401. The two sliding grooves 44 are for receiving the two lateral protruding edges 243 of the first insulating housing 2, respectively, and the two sliding grooves 44 are each formed with a second guiding surface 404 for matching the first mating surface 244 near the top surface 401. The two sliding grooves 44, the second mating surface 403 and a bottom wall 45 cooperatively define a plugging groove 46 capable of receiving the first mating surface 211 and the lateral protruding edges 243. Each of the side walls 43 has a front wall portion 431 located on an opposite side of the second mating surface 403, and a side wall portion 432 connected between the front wall portion 431 and the second mating surface 403. Each front wall portion 431 can be received in the corresponding gap 203 in the first insulating housing 2.

Figure 12:
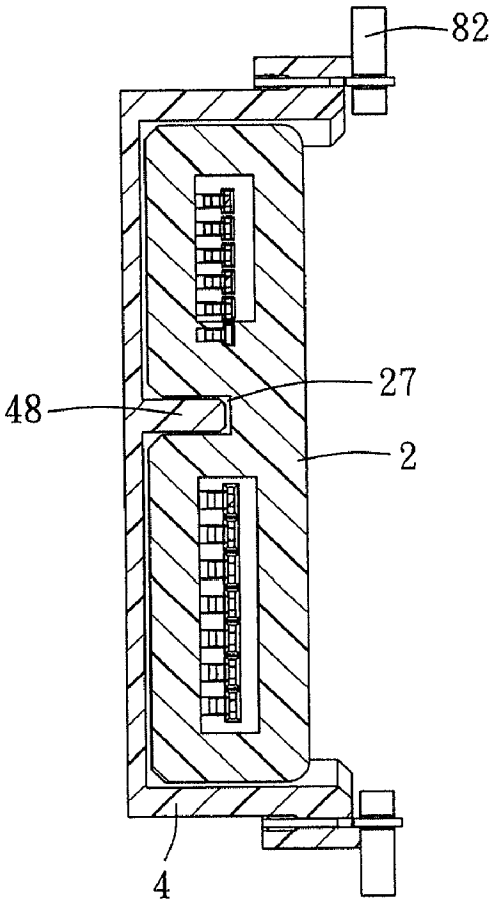
FIG. 12 is a sectional view taken along line X-X in FIG. 10, illustrating the assembly relationship between a notch and a strengthening rib of the first preferred embodiment.
Figure 11:
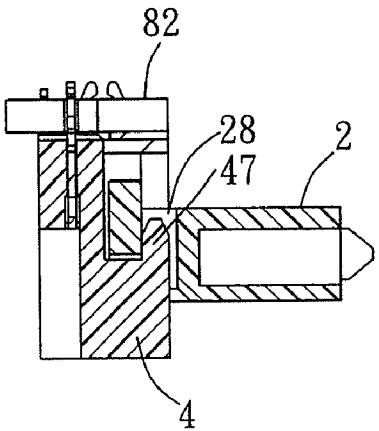
FIG. 11 is a sectional view taken along line IX-IX in FIG. 10, illustrating the assembly relationship between a vertical shaft and a protruding block of the first preferred embodiment.

Moreover, the second insulating housing 4 further has a vertical protruding block 47 that is proximate to the second mating surface 403 and that protrudes upwardly from the bottom wall 45, the vertical protruding block 47 being limited in the vertical shaft 28 of the first insulating housing 2 (refer to FIG. 11), and a strengthening rib 48 that is connected between the protruding block 47 and the second mating surface 403, the strengthening rib 48 being limited in the notch 27 in the first insulating housing 2 (refer to FIG. 12), and being capable of enhancing the strength of the protruding block 47.

A vertical fixing groove 49 is formed in each of two sides of the second insulating housing 4 along a lengthwise direction thereof and between the two areas of the second terminal grooves 41. Each fixing groove 49 is provided for insertion of a fixing member 6 therein. In this embodiment, the fixing member 6 is a board lock member. The fixing members 6 can be retained in fixing holes 821 in the circuit board 82, such that the second electrical connector 12 is fixed to the circuit board 82.

Each of the second conductive terminals 5 is plugged into the corresponding second terminal groove 41 in a direction from the top surface 401 of the second insulating housing 4 to the bottom surface 402, has a fixing segment 51 retained in a groove wall forming the corresponding second terminal groove 41, a soldering segment 52 extending outwardly of the top surface 401 from one end of the fixing segment 51, a resilient segment 53 extending from the other end of the fixing segment 51 toward the bottom surface, and a contacting segment 54 further bending and extending from the resilient segment 53 toward the bottom surface 402, and protruding from the corresponding front opening 42. Each contacting segment 54 is for contacting the adapting segment 34 of the corresponding first conductive terminal 3. When the second electrical connector 12 is fixed to the circuit board 82, the soldering segments 52 of the second conductive terminals 5 will be soldered to the circuit board 82 so as to form electrical connections.

Figure 8:
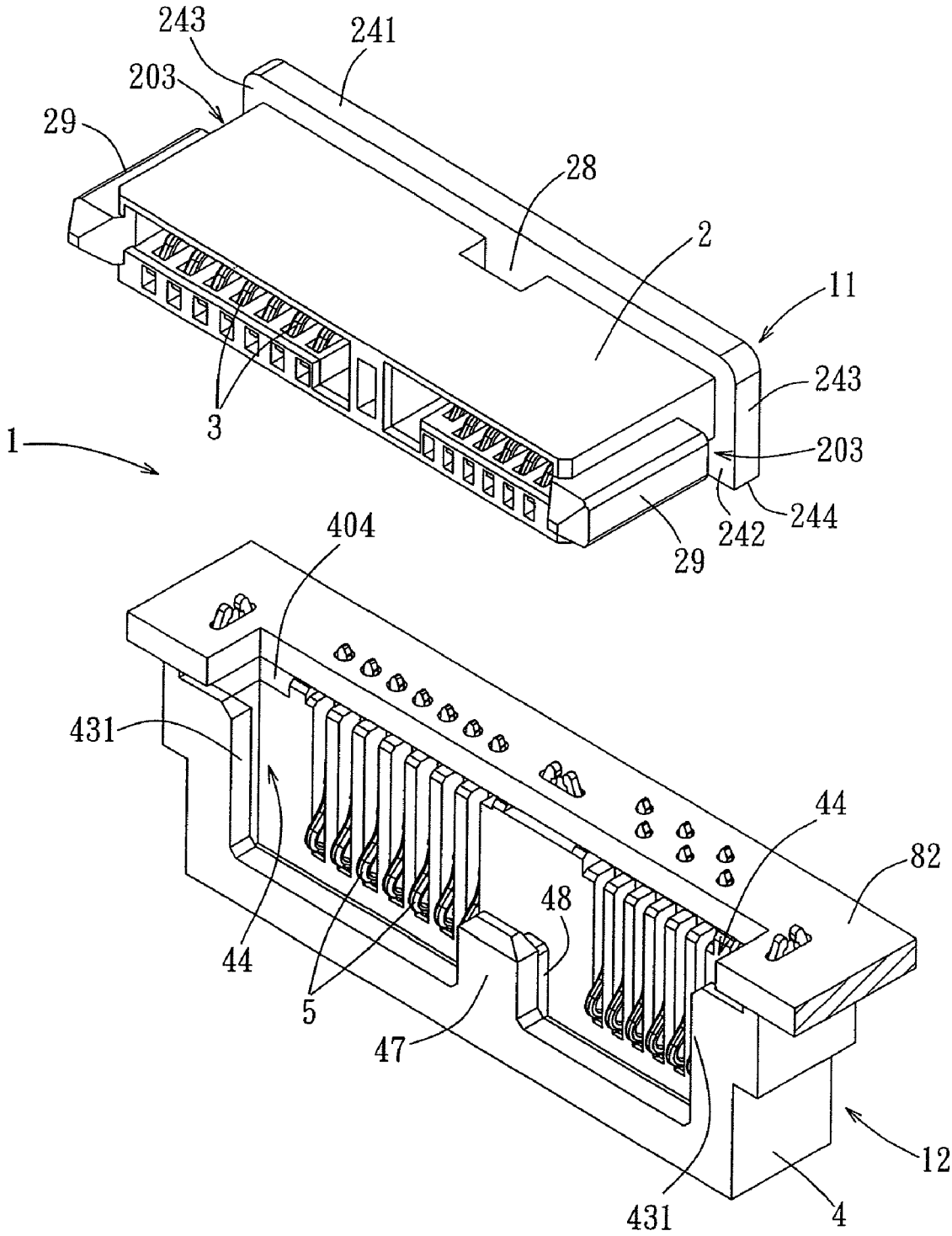
FIG. 8 is a partially assembled view of FIG. 7, illustrating a first electrical connector and a second electrical connector of the first preferred embodiment.
Figure 9:
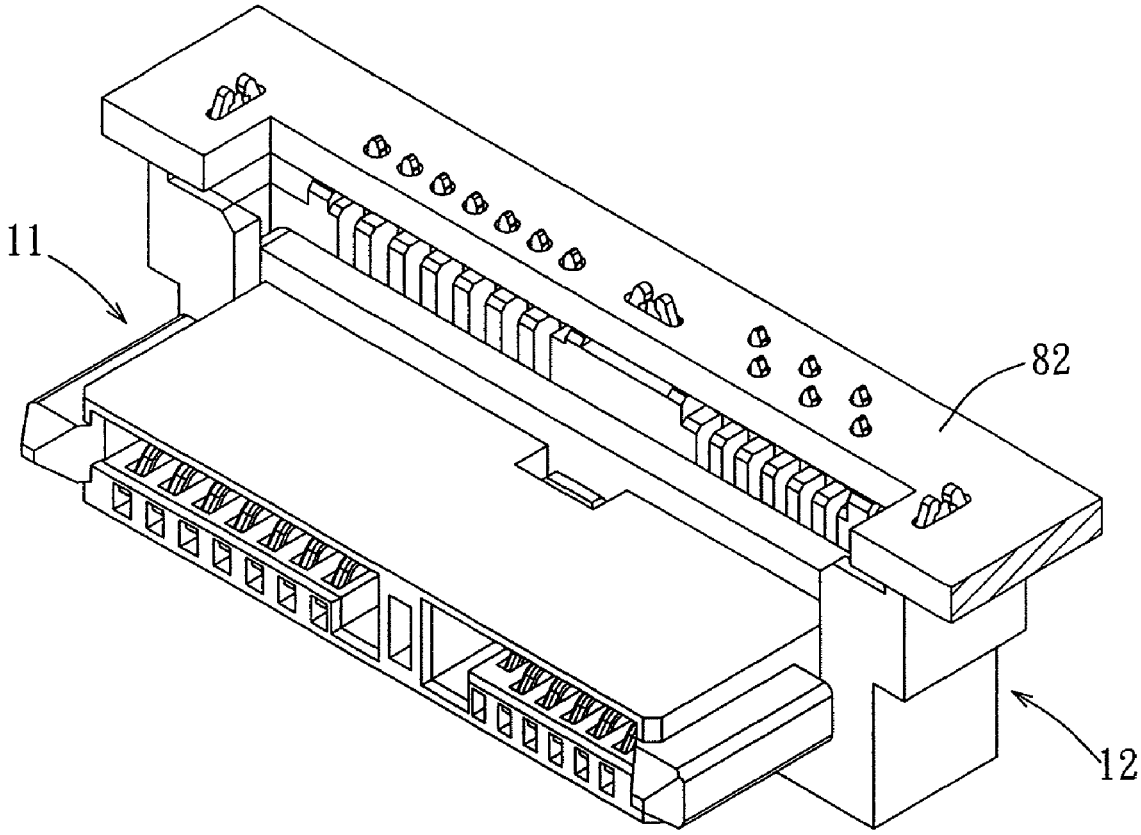
FIG. 9 is an assembled view of FIG. 8, illustrating assembly of the first electrical connector and the second electrical connector.

With reference to FIG. 8 and FIG. 9, when it is desired to mated the first electrical connector 11 with the second electrical connector 12, the first mating surface 211 of the first insulating housing 2 (refer to FIG. 6) is brought to confront the second mating surface 403 of the second insulating housing 4. By using the first guiding surface 244 on the bottom side of the lower protruding edge 243 to register with the second guiding surface 404 of the second insulating housing 4, and by inserting the two lateral protruding edges 243 of the first insulating housing 2 into the second insulating housing 4 along the two sliding grooves 44 of the second insulating housing 4 in a direction from the top surface 401 to the bottom surface 402, the adapting segments 34 of the first conductive terminals 3 (refer to FIG. 7) can be brought into contact with the contacting segments 54 of the second conductive terminals 5 so as to form electrical connections.

Figure 10:
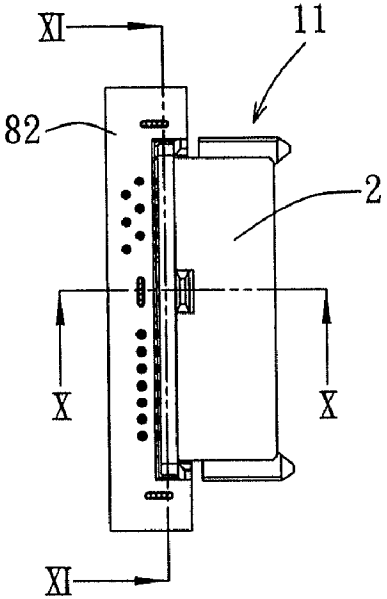
FIG. 10 is a top view, illustrating the first preferred embodiment.

When the first electrical connector 11 and the second electrical connector 12 are coupled, the two lateral protruding edges 243 of the first insulating housing 2 are received in the two corresponding sliding grooves 44 in the second insulating housing 4. The front wall portion 431 forming a wall surface of each of the sliding grooves 44 can be received in the corresponding gap 203 so as to be positioned between the corresponding positioning post 29 and the corresponding lateral protruding edge 243. Moreover, with reference to FIG. 10, FIG. 11 and FIG. 12, the protruding block 47 and the strengthening rib 48 of the second insulating housing 4 are respectively limited in the vertical shaft 28 and the notch 27 in the first insulating housing 2. In addition, the first mating surface 211 of the first insulating housing 2 and one side surface of each of the protruding edges 241, 242, 243 are a continuous flat surface, so that the mating area between the first electrical connector 11 and the second electrical connector 12 is relatively large, and that the contact between the first conductive terminals 3 and the second conductive terminals 5 is more stable when they are mated.

With further reference to FIG. 4 and FIG. 5, the first electrical connector 11 can be first assembled to the electronic device 81 and then mated with the second electrical connector 12 already soldered beneath the circuit board 82. When assembling the first electrical connector 11 to the electronic device 81, the upper and lower protruding edges 241, 242 of the first insulating housing 2 are held with one hand, and the positioning posts 29 on the two sides are used to register with the mating electrical connector 811 on the electronic device 81, and the first electrical connector 11 is then pushed into the mating electrical connector 811, thereby completing the plugging action. During the plugging process, since the upper, lower, and lateral protruding edges 241, 242, 243 and the first mating surface 211 of the first insulating housing 2 are a continuous flat surface, there is a relatively large surface for the application of force, so that force can be easily applied to plug the first electrical connector 11 into the mating electrical connector 811. If the first electrical connector 11 is to be removed from the electronic device 81, force may be applied to the upper and lower protruding edges 241, 242 to unplug the first electrical connector 11 from the mating electrical connector 811.

Certainly, the first electrical connector 11 may also be first mated with the second electrical connector 12, and the electronic device 81 is then coupled with the first electrical connector 11.

The first electrical connector 11 and the second electrical connector 12 are mated in a loose-fit manner, such that the first electrical connector 11 can float in the second electrical connector 12. In particular, there is a greater range of floating in the direction of mating between the first electrical connector 11 and the second electrical connector 12.

Figure 13:
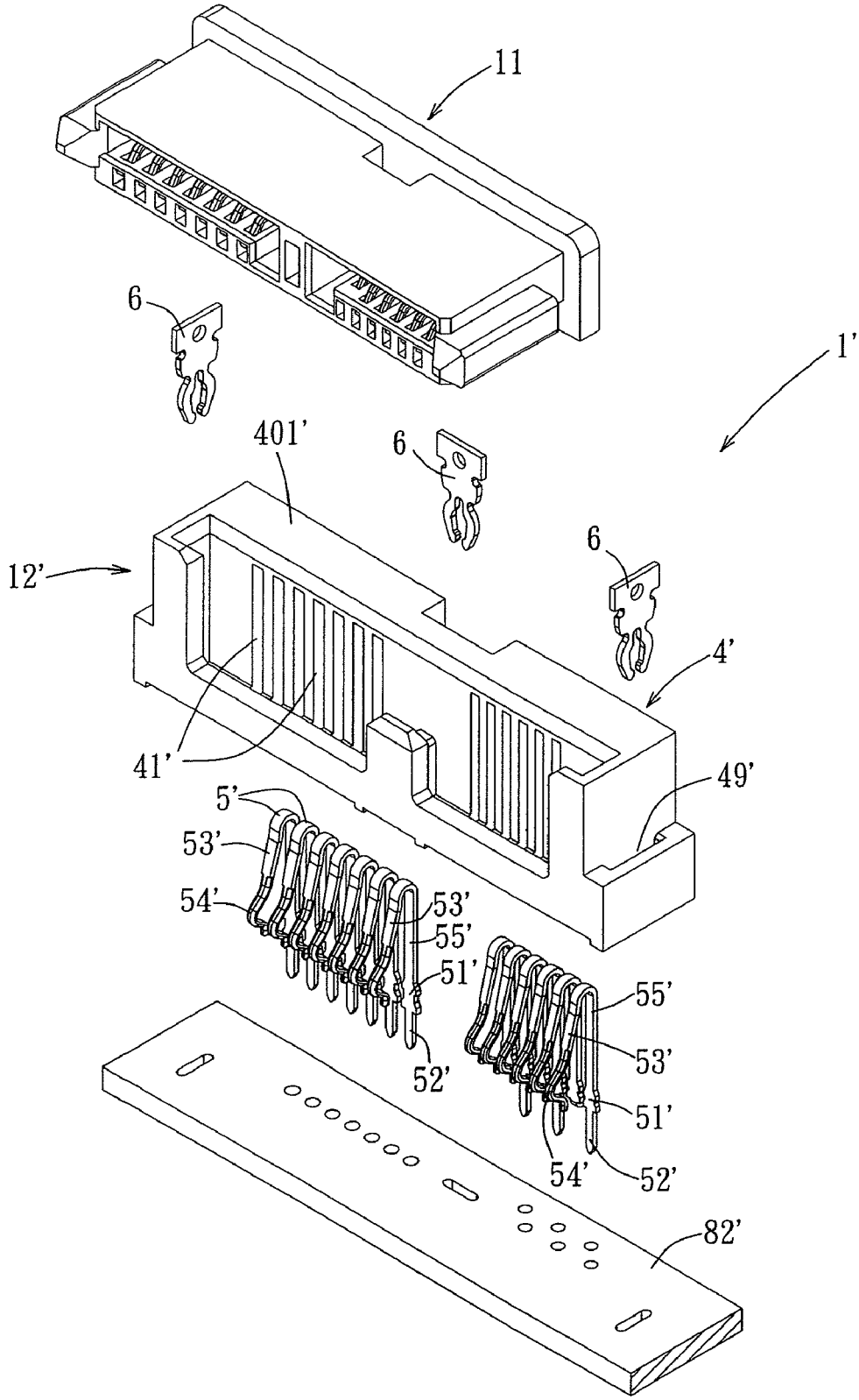
FIG. 13 is a partially exploded perspective view, illustrating components of a second electrical connector of a second preferred embodiment of the floating type electrical connecting device of the present utility model.
Figure 14:
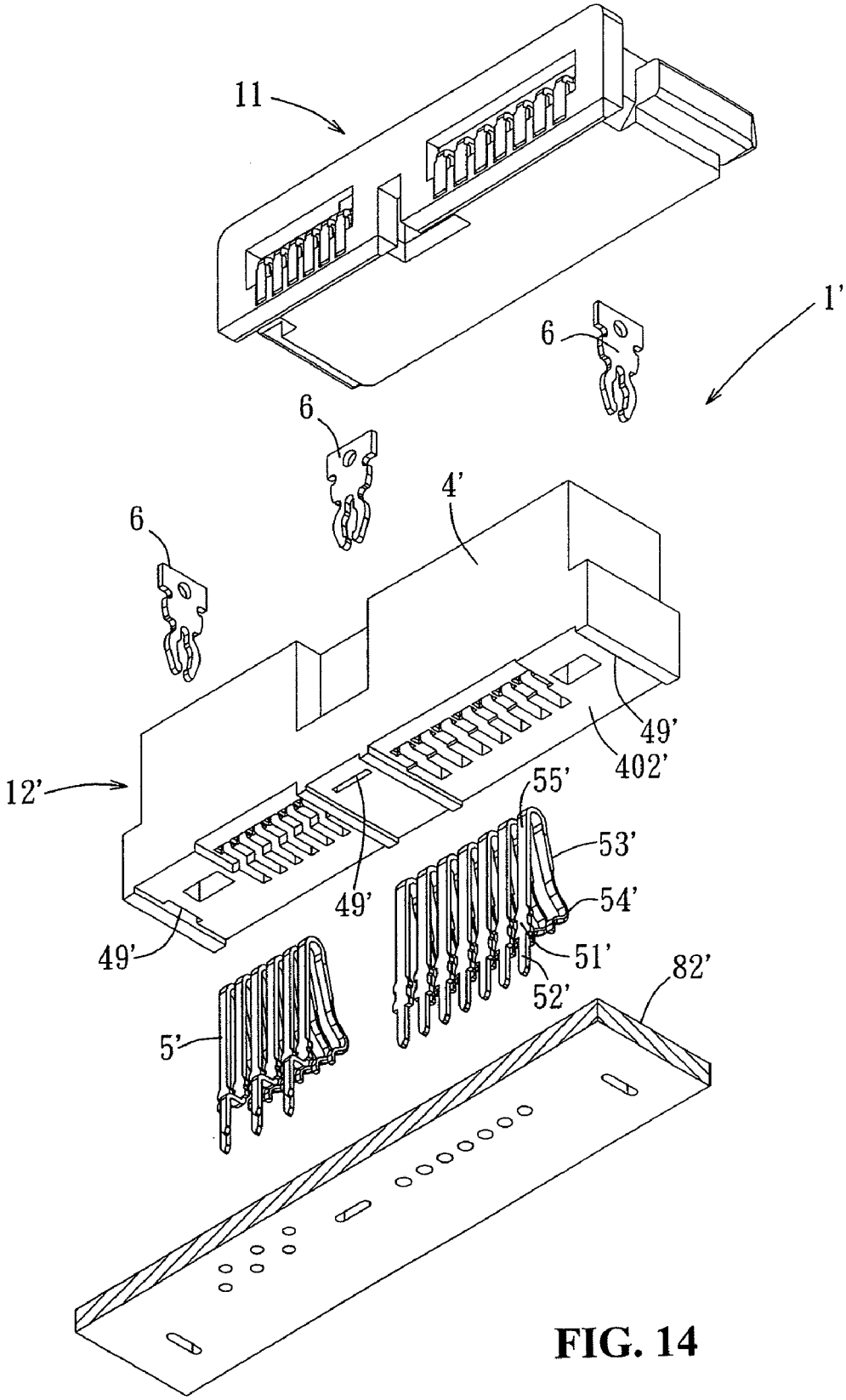
FIG. 14 is an elevational view of FIG. 13 viewed from another angle, illustrating the components of the second electrical connector.

With reference to FIG. 13 and FIG. 14, a second preferred embodiment of the floating type electrical connecting device of the present utility model is generally identical to the first preferred embodiment. However, the floating type electrical connecting device 1' according to the second preferred embodiment is mounted above the circuit board 82', and the circuit board 82' does not require the provision of the notch. The main difference between the first preferred embodiment and the second preferred embodiment lies in that the second electrical connector 12' is mounted above the circuit board 82'. Therefore, in order to make the second electrical connector 12' suitable for mounting above the circuit board 82', the second insulating housing 4' and the second conductive terminals 5' of the second electrical connector 12' are slightly different from those of the first preferred embodiment described above.

In the second preferred embodiment, the second terminal grooves 41' are disposed along a direction from the top surface 401' to the bottom surface 402, and extend through the bottom surface 402', such that the second terminal grooves 41' are closed at the top surface 401' so as to prevent dusts from falling into the second terminal grooves 41'. Moreover, three vertical fixing grooves 49' are provided adjacent to the bottom surface 402', such that the fixing members 6 can be extended in a top-down direction into the fixing grooves 49' to thereby fix the second insulating housing 4' onto the circuit board 82'.

Furthermore, the fixing segment 51' of each of the second conductive terminals 5' is fixed to the corresponding second terminal groove 41' adjacent to the bottom surface 402' of the second insulating housing 4', and the soldering segment 52' extends downwardly from one end of the fixing segment 51' and outwardly of the bottom surface 402' for soldering to the circuit board 82'. In order that the contacting segment 54' of each of the second conductive terminals 5' can likewise protrude from the corresponding front opening 42' at a location proximate to the bottom surface 402', each of the second conductive terminals 5' further has a connecting segment 55' extending upwardly from the other end of the fixing segment 51' toward the top surface 401', and further bending and extending downwardly in an inverted U-shape toward the corresponding front opening 42'. The resilient segment 53' extends obliquely downward from the other end of the connecting segment 55' toward the corresponding front opening 42', and is connected to the contacting segment 54'. Each of the second conductive terminals 5' is inserted into the corresponding second terminal groove 41' from the bottom surface 402' toward the top surface 401' of the second insulating housing 4'.

Figure 16:
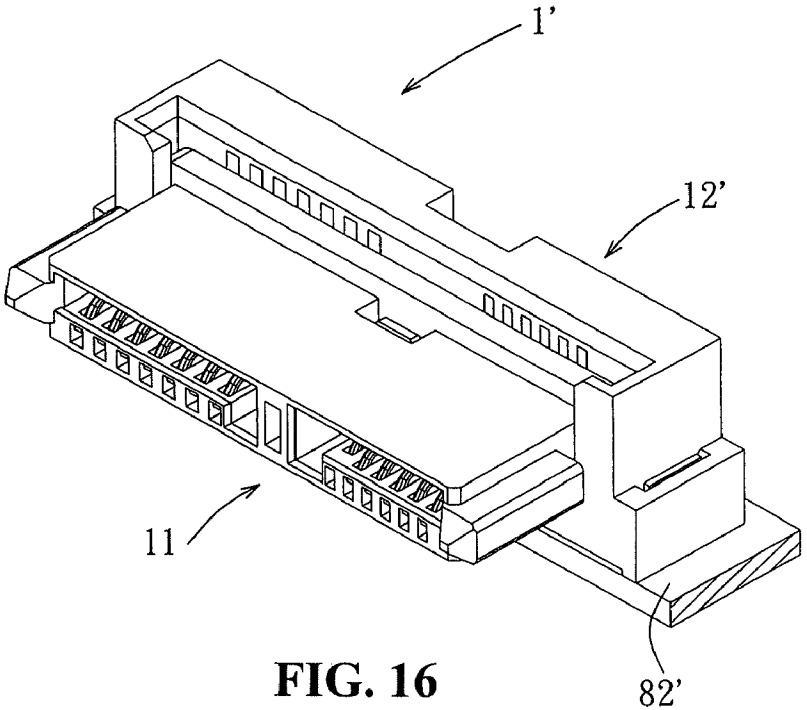
FIG. 16 is an assembled view of FIG. 15, illustrating assembly of the first electrical connector and the second electrical connector.
Figure 15:
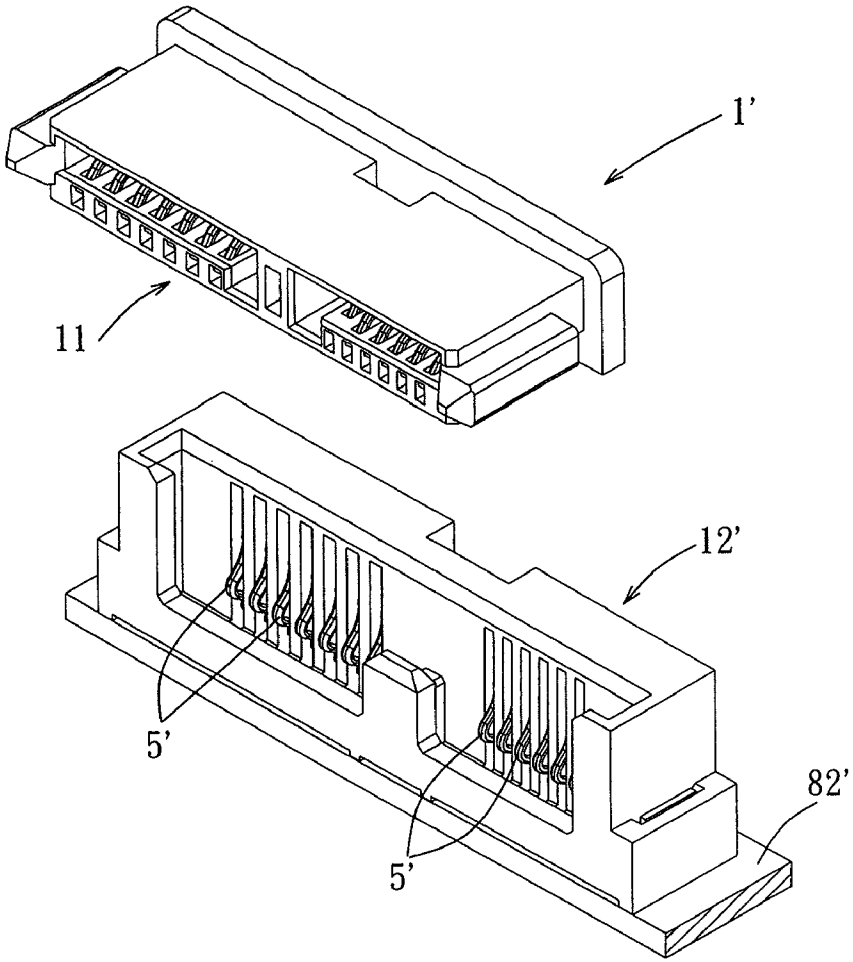
FIG. 15 is a partially assembled view of FIG. 13, illustrating a first electrical connector and a second electrical connector of the second preferred embodiment.
Figure 17:
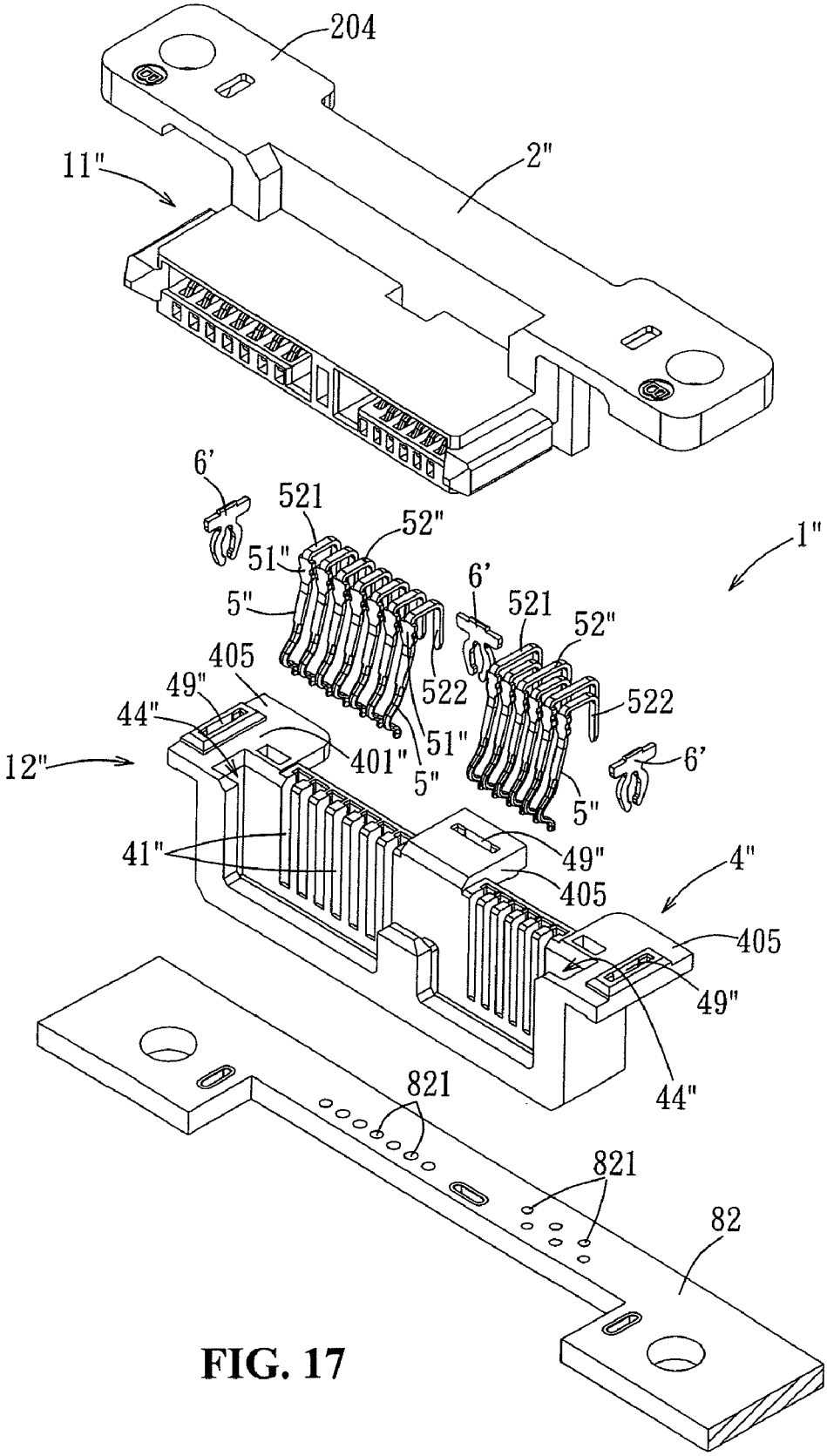
FIG. 17 is a partially exploded perspective view, illustrating components of a second electrical connector of a third preferred embodiment of the floating type electrical connecting device of the present utility model.
Figure 18:
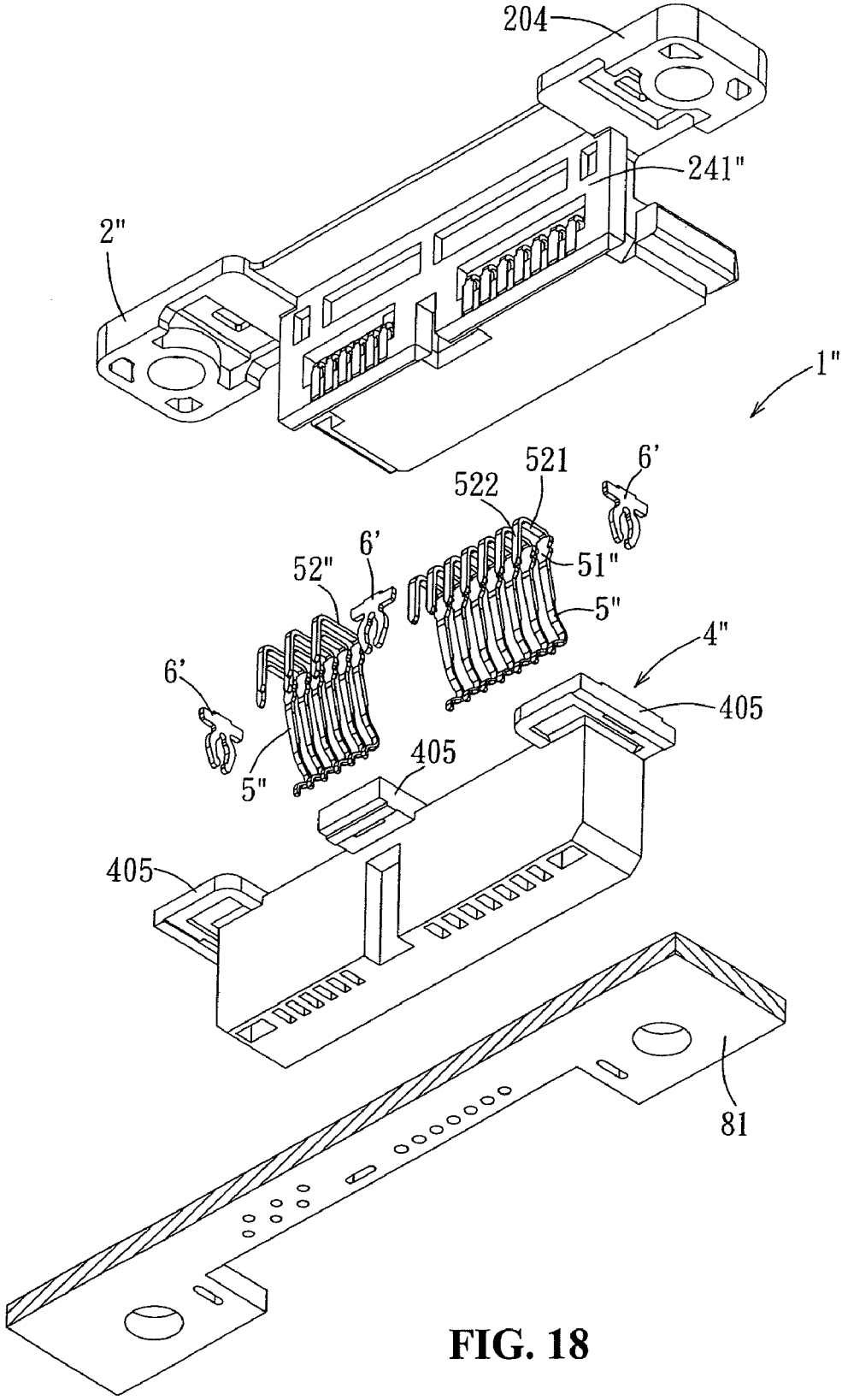
FIG. 18 is an elevational view of FIG. 17 viewed from another angle, illustrating the components of the second electrical connector.
Figure 19:
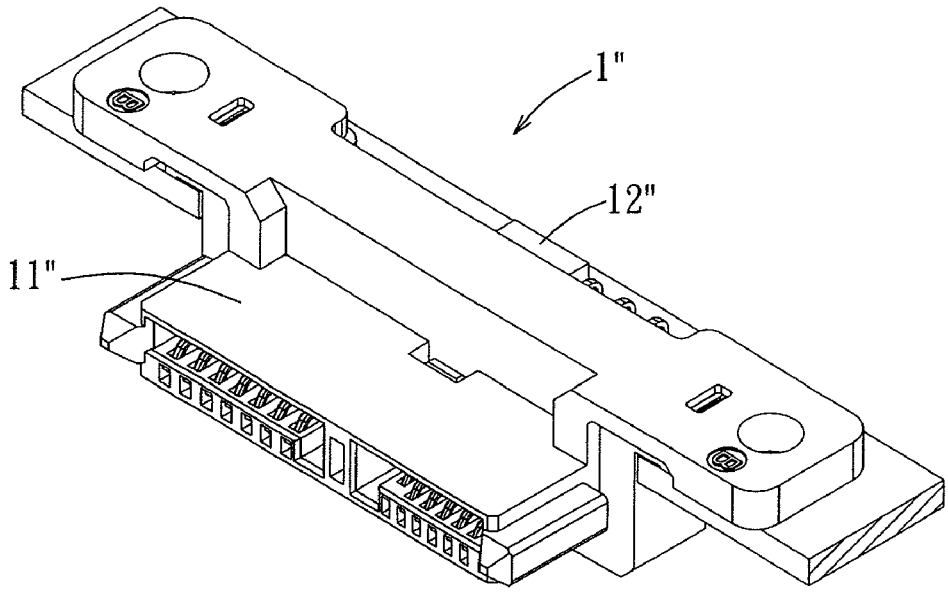
FIG. 19 is an assembled view of FIG. 17, illustrating assembly of a first electrical connector and a second electrical connector of the third preferred embodiment.
Figure 20:
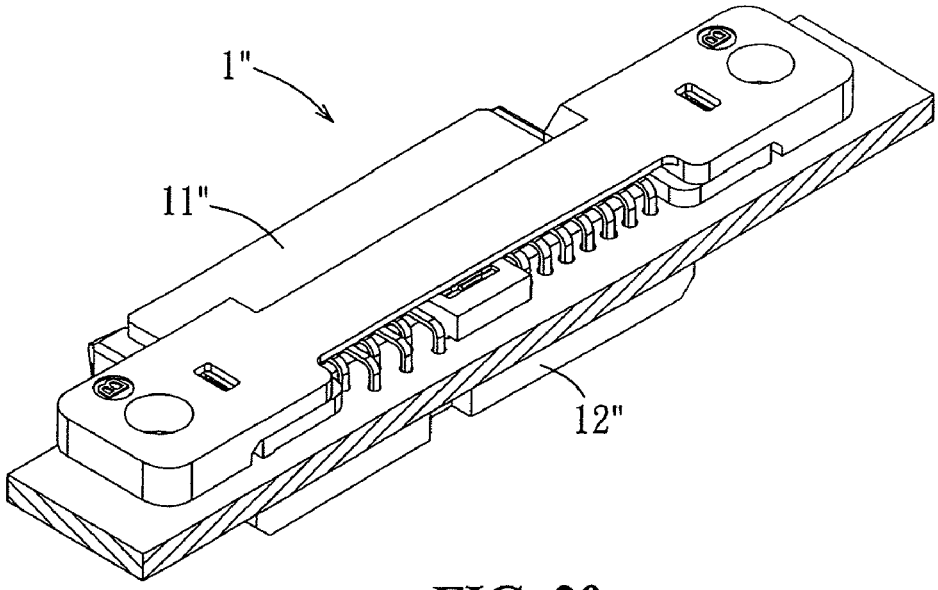
FIG. 20 is an elevational view of FIG. 19 viewed from another angle, illustrating the assembly of the first electrical connector and the second electrical connector.

With reference to FIG. 15 and FIG. 16, after assembly of the second conductive terminals 5' to the second insulating housing 4' is completed, the second electrical connector 12' is formed. After mounting the second electrical connector 12' above the circuit board 82', by mating the first electrical connector 11 with the second electrical connector 12' in a top-down direction, electrical connection is formed between the first electrical connector 11 and the second electrical connector 12'. Identical to the first preferred embodiment, in this embodiment, the electronic device 81 (refer to FIG. 4) can be initially connected pluggingly to the first electrical connector 11, after which the first electrical connector 11 is mated with the second electrical connector 12'. Or the first electrical connector 11 may be initially mated with the second electrical connector, after which the electronic device 81 is connected pluggingly to the first electrical connector 11. Both can form electrical connection between the electronic device 81 and the circuit board 82'.

With reference to FIG. 17-FIG. 20, a third preferred embodiment of the floating type electrical connecting device of the present utility model is generally identical to the first preferred embodiment. However, the floating type electrical connecting device 1" according to the third preferred embodiment is mounted to the circuit board 82 in a sinking manner. Therefore, the main difference between the third preferred embodiment and the first preferred embodiment resides in that structures of the first and second insulating housings 2", 4" and the second conductive terminals 5" of the third preferred embodiment are slightly different from those of the first preferred embodiment.

In this embodiment, the second insulating housing 4" further has two wing plates 405 respectively connected to the sliding grooves 44" at the top surface 401", and a wing plate 405 disposed between the two areas of the second terminal grooves 41". The wing plates 405 protrude and extend horizontally from the top surface 401" of the second insulating housing 4", and can be provided on an upper surface of the circuit board 82. Moreover, the wing plates 405 are provided with the fixing grooves 49" for insertion of the fixing members 6' in a top-down direction, such that the second insulating housing 4" is fixed to the circuit board 82, and such that the second electrical connector 12" can be received in the indentation 822 in the circuit board 82.

In order to match the arrangement that a major portion of the second insulating housing 4" is located beneath the circuit board 82, while a portion thereof is disposed above the circuit board 82, the soldering segment 52" of each of the second conductive terminals 5" has a first bending portion 521 bending and extending horizontally from the fixing segment 51" in a direction away from the second mating surface 403", and a second bending portion 522 bending and extending downwardly from the first bending portion 521. The first bending portions 521 can straddle the second insulating housing 4" and the circuit board 82, and the second bending portions 522 can extend from above the circuit board 82 downwardly through the fixing holes 821 and be soldered to the circuit board 82.

Moreover, the first insulating housing 2" further has a shielding plate 204 connected to the upper protruding edge 241". The shape of the shielding plate 204 can cooperate with the wing plates 405 of the second insulating housing 4" such that, after the first electrical connector 11" passes through the indentation 822 in the circuit board 82 in the top-down direction to mate with the second electrical connector 12", the shielding plate 204 can shield openings of the second terminal grooves 41" at the side of the top surface 401" so as to prevent dusts from falling into the second terminal grooves 41".

In sum, in the floating type electrical connecting device of the present utility model, the first insulating housing utilizes two lateral protruding edges as guide rails. The two lateral protruding edges protrude from the respective side surfaces at locations adjacent to the first mating surface, and are capable of forming a continuous flat surface with the first mating surface, such that the first insulating housing and the matching second insulating housing have a neat shape, rendering mold-making easier, and facilitating production utilizing injection molding process. In addition, the two lateral protruding edges are connected to the side surfaces of the first insulating housing along the lengthwise directions thereof, such that stress can be more distributed and breaking is not likely, thereby enhancing the strength of the first insulating housing.

Further, the first insulating housing can be formed with a lower protruding edge and an upper protruding edge which are connected to the two lateral protruding edges so that the area for application of force to grip the first electrical connector can be increased, so as to facilitate assembly of the first electrical connector to an electronic device. Moreover, through the upper and lower protruding edges that are connected to the two lateral protruding edges to strengthen the two lateral protruding edges, the strength and stability of the connection between the first electrical connector and the second electrical connector can be enhanced. In addition, the concrete embodiments of the floating type electrical connecting device of the present utility model provide three arrangements that permit mounting of the second electrical connector above, below, or sinkingly in the circuit board to thereby increase selectivity in use.

However, the foregoing description is merely intended to illustrate the preferred embodiments of the present utility model, and should not be based upon to limit the scope of the present utility model. In other words, any simple equivalent variations and modifications made according to the claims of the present utility model and the contents of the specification of the present utility model should fall within the scope covered by a patent to the present utility model.

The invention claimed is:

1. A floating type electrical connecting device, comprising:

a first electrical connector including: a first insulating housing and a plurality of first conductive terminals; said first insulating housing having a first mating surface, a plugging surface located on an opposite side of said first mating surface, two side surfaces respectively connected to opposite left and right sides of said first mating surface and said plugging surface, and a plurality of first terminal grooves extending from said mating surface to said plugging surface through said first insulating housing for receiving said first conductive terminals, each of said side surfaces being formed with a vertical side protruding edge adjacent to said first mating surface and protruding from a corresponding one of said side surfaces; and a second electrical connector including: a second insulating housing and a plurality of second conductive terminals; said second insulating housing having a top surface, a bottom surface, a second mating surface, and a plurality of second terminal grooves disposed along a direction from said top surface to said bottom surface for receiving said second conductive terminals, said second mating surface being formed with a plurality of front openings that are communicated respectively with said second terminal grooves, two sliding grooves being respectively formed in two sides of said second insulating housing adjacent to said second mating surface, said two sliding grooves being respectively disposed for receiving said two lateral protruding edges of said first insulating housing.

2. The floating type electrical connecting device according to claim 1, wherein a side of each of said lateral protruding edges which is adjoined to said second mating surface forms a continuous flat surface with said first mating surface.

3. The floating type electrical connecting device according to claim 1, wherein said first insulating housing further has an upper side surface and a lower side surface connected respectively to opposite upper and lower sides of said first mating surface and said plugging surface, and said first insulating housing is further formed with a lower protruding edge protruding from said lower side surface and connected to said two lateral protruding edges.

4. The floating type electrical connecting device according to claim 2, wherein said first insulating housing further has an upper side surface and a lower side surface respectively connected to opposite upper and lower sides of said first mating surface and said plugging surface, and said first insulating housing is further formed with a lower protruding edge protruding from said lower side surface and connected to said two lateral protruding edges, sides of said two lateral protruding edges and said lower protruding edge which are adjoined to said second mating surface being a continuous flat surface with said first mating surface.

5. The floating type electrical connecting device according to claim 3, wherein said first insulating housing is further formed with an upper protruding edge protruding from said upper side surface and connected to said two lateral protruding edges.

6. The floating type electrical connecting device according to claim 4, wherein said first insulating housing is further formed with an upper protruding edge protruding from said upper side surface and connected to said two lateral protruding edges, sides of said two lateral protruding edges, said upper protruding edge and said lower protruding edge which are adjoined to said second mating surface being a continuous flat surface with said first mating surface.

7. The floating type electrical connecting device according to claim 6, wherein said first insulating housing is further formed with a vertical shaft proximate to said first mating surface, and said second insulating housing further has a vertical protruding block proximate to said second mating surface and being limited in said vertical shaft.

8. The floating type electrical connecting device according to claim 7, wherein said second insulating housing further has a strengthening rib connected between said protruding block and said second mating surface, and said first insulating housing is further formed with a notch capable of being limited at said strengthening rib in said lower protruding edge.

9. The floating type electrical connecting device according to claim 1, wherein said two sliding grooves of said second insulating housing are respectively defined cooperatively by two L-shaped side walls that are connected to two sides of said second mating surface in a longitudinal direction thereof and that are opposite to each other, and an entrance of each of said sliding grooves is located at said top surface; each of said side walls having a front wall portion that is located on an opposite side of said second mating surface, and a side wall portion that is connected between said front wall portion and said second mating surface.

10. The floating type electrical connecting device according to claim 9, wherein said first insulating housing further has two horizontal positioning posts respectively disposed on said side surfaces, and each of said positioning posts forms a gap with a corresponding one of said lateral protruding edges for receiving a corresponding one of said front wall portions, such that each of said front wall portions can be located between the corresponding one of said positioning posts and the corresponding one of said lateral protruding edges.

11. The floating type electrical connecting device according to claim 1, wherein each of said first conductive terminals is disposed in a corresponding one of said first terminal grooves, and has a flat plate-shape adapting segment protruding outwardly of the corresponding one of said first terminal grooves, and located on said first mating surface; said first insulating housing being further formed with a plurality of positioning grooves corresponding to said first conductive terminals in said first mating surface for receiving said adapting segments of said first conductive terminals.

12. The floating type electrical connecting device according to claim 3, wherein each of said first conductive terminals is disposed in a corresponding one of said first terminal grooves, and has a flat plate-shape adapting segment protruding outwardly of the corresponding one of said first terminal groove, and located on said first mating surface; said first insulating housing being further formed with a plurality of positioning grooves that extend from said first mating surface to said lower protruding edge, and that correspond to said first conductive terminals for receiving said adapting segments of said first conductive terminals.

13. The floating type electrical connecting device according to claim 12, wherein each of said second conductive terminals is disposed in a corresponding one of said second terminal grooves, and has a contacting segment protruding from the corresponding one of said front openings proximate to said bottom surface of said second insulating housing for contacting said adapting segment of the corresponding one of said first conductive terminals.

14. The floating type electrical connecting device according to claim 13, wherein each of said second terminal grooves extend through said bottom surface of said second insulating housing; each of said second conductive terminals further having a fixing segment that is fixed in the corresponding one of said second terminal grooves proximate to said bottom surface of said second insulating housing, a soldering segment that extends downwardly from an end of said fixing segment through said bottom surface, a connecting segment that extends upwardly from the other end of said fixing segment toward said top surface and that further bends and extends downwardly in an inverted U-shape toward the corresponding one of said front openings, and a resilient segment that extends obliquely downward from the other end of said connecting segment toward the corresponding one of said front openings, said contacting segment bending and extending from the other end of said resilient segment in the direction toward said bottom surface, and protruding outwardly of the corresponding one of said front openings.

15. The floating type electrical connecting device according to claim 4, wherein said lower protruding edge of said first insulating housing is formed with a first guiding surface, and wall surfaces forming said two sliding grooves of said second insulating housing are each formed with a second guiding surface proximate to said top surface and cooperating with said first guiding surface.

16. The floating type electrical connecting device according to claim 1, further comprising: a circuit board formed with an indentation, and each of said second terminal grooves extends through said top surface of said second insulating housing.

17. The floating type electrical connecting device according to claim 16, wherein each of said second conductive terminals has a fixing segment fixed in the corresponding one of said second terminal grooves, a soldering segment extending from one end of said fixing segment outwardly of said top surface of said second insulating housing, a resilient segment extending from the other end of said fixing segment toward said bottom surface, and a contacting segment bending and extending from the other end of said resilient segment toward said bottom surface and protruding outwardly of the corresponding one of said front openings; each of said contacting segments being proximate to said bottom surface of said second insulating housing for contacting said adapting segment of the corresponding one of said first conductive terminals, each of said soldering segments extending upwardly through said circuit board from therebelow and being soldered to said circuit board, said first electrical connector being capable of passing through said indentation in said circuit board in a top-down direction to be mated with said second electrical connector.

18. The floating type electrical connecting device according to claim 16, wherein each of said second conductive terminals has a fixing segment fixed to the corresponding one of said second terminal grooves, a soldering segment extending from one end of said fixing segment outwardly of said top surface of said second insulating housing, a resilient segment extending from the other end of said fixing segment toward said bottom surface, and a contacting segment bending and extending from the other end of said resilient segment toward said bottom surface and protruding outwardly of the corresponding one of said front openings; each of said contacting segments being proximate to said bottom surface of said second insulating housing for contacting said adapting segment of the corresponding one of said first conductive terminals, each of said soldering segments having a first bending portion that bends and extends horizontally from said fixing segment in a direction away from said second mating surface, and a second bending portion that further bends and extends downwardly from said first bending portion, each of said second bending portions extending through said circuit board in a top-down direction, and being soldered to said circuit board, said first electrical connector being capable of passing through said indentation in said circuit board in the top-down direction to be mated with said second electrical connector.

19. The floating type electrical connecting device according to claim 18, wherein said second insulating housing further has two wing plates respectively connected to said sliding grooves at said top surface, and said two wing plates can be disposed on an upper surface of said circuit board so that said second electrical connector can be received in said indentation.

20. The floating type electrical connecting device according to claim 19, wherein said first insulating housing further has a shielding plate connected to said upper protruding edge, said first electrical connector can pass through said indentation in said circuit board in the top-down direction to be mated with said second electrical connector, and said shielding plate can shield openings of said second terminal grooves at said top surface side.

* * * * *